US006072408A

United States Patent [19]

Baer et al.

[11] Patent Number: 6,072,408

[45] Date of Patent: Jun. 6, 2000

[54] SIMULATING THE PRESENCE OF A LARGE MOTOR VEHICLE IN AN INDUCTIVE LOOP OF A VEHICULAR TRAFFIC SIGNAL LIGHT CONTROL SYSTEM

[76] Inventors: Chuck E. Baer, 6058 Mirror Lake Dr., Las Vegas, Nev. 89110; Gary Sunda, 13172 Donegal Dr., Garden Grove, Calif. 92844

[21] Appl. No.: 08/938,135

[22] Filed: Sep. 26, 1997

[51] Int. Cl.[7] ..... G08G 1/00

[52] U.S. Cl. ..... 340/908; 340/918; 340/941; 342/44

[58] Field of Search ..... 340/907, 908, 340/916, 918, 919, 931, 941; 342/44

[56] References Cited

U.S. PATENT DOCUMENTS

| | | | |
|---|---|---|---|
| 3,839,717 | 10/1974 | Paul | 340/905 |
| 3,943,339 | 3/1976 | Koerner et al. | 340/941 |
| 3,989,932 | 11/1976 | Koerner | 340/941 |
| 4,038,633 | 7/1977 | King | 340/941 |
| 4,131,848 | 12/1978 | Battle | 340/941 |
| 4,321,589 | 3/1982 | King | 340/941 |
| 4,358,749 | 11/1982 | Clark | 340/941 |
| 4,430,636 | 2/1984 | Bruce | 340/933 |
| 4,566,008 | 1/1986 | Powers et al. | 340/941 |
| 4,595,877 | 6/1986 | Dulk | 340/941 |
| 4,731,867 | 3/1988 | Seabury et al. | 340/941 |
| 4,996,716 | 2/1991 | Potter et al. | 340/941 |
| 5,057,831 | 10/1991 | Strang et al. | 340/941 |
| 5,089,815 | 2/1992 | Potter et al. | 340/941 |
| 5,198,811 | 3/1993 | Potter et al. | 340/941 |
| 5,247,297 | 9/1993 | Seabury et al. | 340/941 |
| 5,652,577 | 7/1997 | Frasier | 340/941 |

*Primary Examiner*—Daniel J. Wu

*Attorney, Agent, or Firm*—Robert Ryan Morishita; Quirk & Tratos

[57] ABSTRACT

In a first embodiment, a voltage controlled oscillator (VCO) is driven by a generator that provides a cyclic voltage having a sawtooth waveform. The VCO cyclicly provides a signal at a frequency that varies over a range that includes a frequency of a transmitted signal that causes a vehicular traffic signal light control system, of a type that has an inductive loop buried in a roadway, to provide a desired illumination of traffic signal lights of the system. The VCO is connected to a power amplifier that has its output connected to an antenna. In a second embodiment, a signal processor provides a train of pulses at a frequency of radiation from the inductive loop. The number of the pulses of the pulse train that are provided during a timing interval is stored by a counter. A digital to analog converter is connected to the output of the counter. After the timing interval, a signal is transmitted substantially at the frequency of radiation in response to the output of a VCO that is connected to the converter.

15 Claims, 3 Drawing Sheets

30
INPUT PULSE (a)
TRAIN
54
INITIATION (b)
PULSE
55
TIMING (c)
VOLTAGE
GATED (d)
PULSES
90
91
92
94
RING COUNTER (e)
INPUT PULSES
845
CLOSURE SIGNAL (f)
AT OUTPUT 84
865
CLOSURE SIGNAL (g)
AT OUTPUT 86
885
CLOSURE SIGNAL (h)
AT OUTPUT 88

SIMULATING THE PRESENCE OF A LARGE MOTOR VEHICLE IN AN INDUCTIVE LOOP OF A VEHICULAR TRAFFIC SIGNAL LIGHT CONTROL SYSTEM

FIELD OF THE INVENTION

This invention relates generally to vehicular traffic signal light control systems and, more particularly, to an apparatus for simulating the presence of a vehicle in an inductive loop of a vehicular traffic signal light control system.

DESCRIPTION OF THE PRIOR ART

One type of vehicular traffic signal light control system includes an inductive loop that is buried beneath a roadway, typically at an intersection. The loop is an element of an oscillator. The presence of a large motor vehicle in the loop, such as an automobile, causes a significant change in the inductance of the loop, thereby causing a change in the frequency of the oscillator.

In response to the change in the frequency, a computer of the system executes a sequence of operations that causes a sequential illumination of red and green traffic signal lights of the system. A desired illumination of one of the green traffic signal lights indicates to a driver of the automobile that passage through the intersection is permitted. Alternatively, the system may cause the desired illumination of the green light without an execution of the sequence.

When the vehicle is small, such as a motorcycle, its presence in the loop may not cause a significant change in the inductance whereby the sequence is not executed. Thus, a motorcycle driver may have to wait at the intersection until a large vehicle at the intersection causes the significant change in the inductance.

The subject matter of U.S. Pat. No. 5,057,831 is a device for simulating of the presence of the large vehicle in the loop. The device is contemplated for use by a driver of the small vehicle.

The device of the '831 Patent includes a receiving antenna that receives a signal that is radiated from the loop, an amplifier that amplifies the received signal and a transmitting antenna from which the amplified signal is transmitted. However, there are factors, such as the orientation of the antennas on the small vehicle, that may cause the device of the '831 Patent to "lock up" and thereby become inoperable.

Thus, there is a need for an apparatus that is used on the small vehicle that simply and reliably causes the desired illumination of the traffic signal lights.

SUMMARY OF THE INVENTION

An object of the present invention is to simulate the presence of a large vehicle within an inductive loop of a vehicular traffic signal light control system.

Another object of the present invention is to cause a desired sequential illumination of traffic signal lights of a vehicular traffic signal light control system to indicate that passage of a motor vehicle through an intersection is permitted.

In one specific embodiment of the present invention, a generator provides an output voltage of varying amplitude to a voltage controlled oscillator (VCO). The VCo provides an output signal of substantially constant amplitude with a frequency that varies in a manner corresponding to variations in the amplitude of the generator output voltage. The VCO output is provided to a power amplifier that drives an antenna.

In another specific embodiment of the present invention, during a time interval, signals are stored that are representative of the frequency of a radiated output of an inductive loop of a vehicular traffic control system. After the time interval, a signal having a frequency that is directly related to the radiated output frequency is transmitted in response to the stored signals.

The invention provides simple and reliable apparatus and a method for prompting a sequential illumination of traffic lights of a vehicular traffic signal light control system.

DESCRIPTION OF THE EMBODIMENTS

In each of two embodiments, apparatus is described that prompts a sequential illumination of traffic signal lights of a vehicular traffic signal light control system that is, green, followed by yellow, followed by red, followed by green and so on, to permit passage of a motor vehicle through an intersection. The traffic control system is of a type that has an inductive loop buried in a roadway. The apparatus is typically mounted on a small vehicle, such as a motorcycle.

Figure 1:
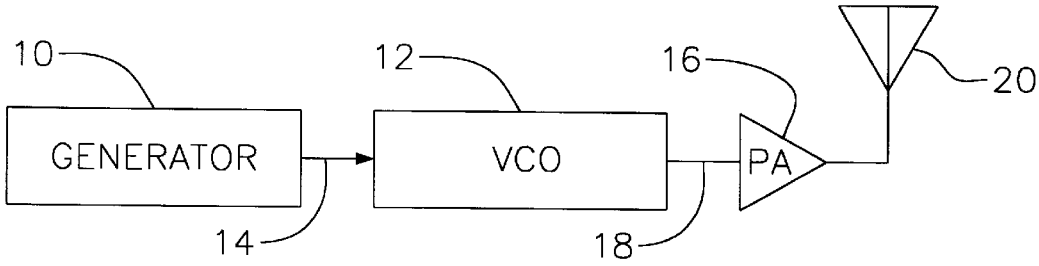
FIG. 1 is a block diagram of a first embodiment of the present invention.
Figure 2:
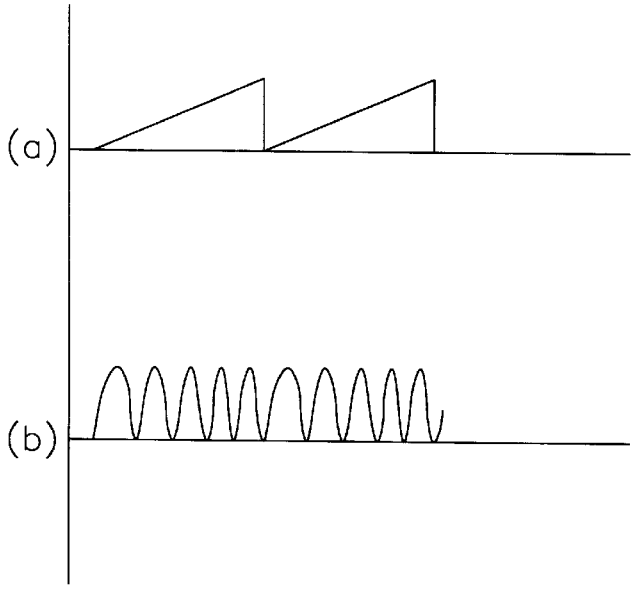
FIG. 2 is a showing of waveforms, all on the same time base, of signals provided in the embodiment of FIG. 1.

As shown in FIGS. 1 and 2, in a first embodiment of the present invention, a signal generator 10 provides a cyclic voltage having a sawtooth waveform (FIG. 2(*a*)) which is referred to hereinafter as a sawtooth voltage. The frequency of the sawtooth voltage is on the order of one hertz. The output of the signal generator 10 is connected to a voltage controlled oscillator (VCO) 12 through a signal line 14 whereby the sawtooth voltage is applied to the input of the VCO 12.

The VCO 12 is a device that provides a signal of substantially constant amplitude at a frequency that is directly related to the amplitude of a voltage applied to its input. In response to the sawtooth voltage, the VCO 12 cyclically provides a signal (FIG. 2(*b*)) that has a frequency that varies within a 20 kilohertz to 200 kilohertz range of frequencies. All known vehicular traffic signal light control systems, of the type that include the buried inductive loop, provide the desired illumination of the traffic signal lights in response to a transmitted signal having a frequency within the 20 kilohertz to 200 kilohertz range. VCO's are well known to those skilled in the art.

The output of the VCO 12 is connected to a power amplifier 16 at its input through a signal line 18. An antenna 20 is connected to the output of the amplifier 16. In response to the output of the VCO 12, the amplifier 16 causes the antenna 20 to transmit a signal having the varying frequency at a power level on the order of five watts. The transmission from the antenna 20 causes the desired illumination.

Figure 3:
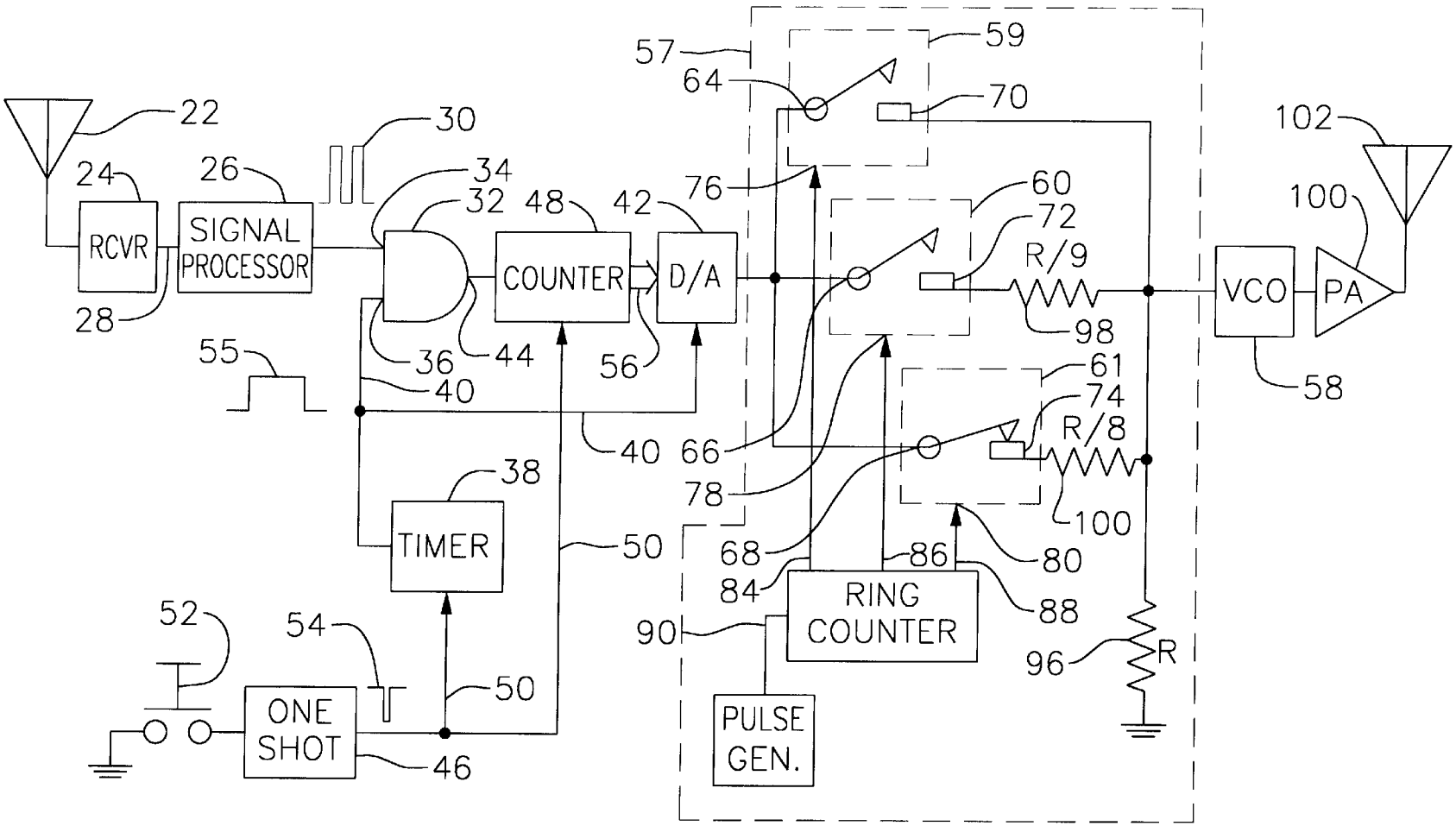
FIG. 3 is a schematic block diagram of a second embodiment of the present invention.

As shown in FIG. 3, in a second embodiment of the present invention, a radiated output of the buried inductive loop (not shown) is received by an input antenna 22 that is connected to a receiver 24 at an input thereof. An output of the receiver 24 provides a voltage having the frequency of the radiated output of the inductive loop.

The output of the receiver 24 is connected to a signal processor circuit 26 through a signal line 28. In response to the voltage at the output of the receiver 24, the processor circuit 26 provides a train of input pulses at a pulse repetition rate that is equal to the radiated output frequency. A waveform 30 is a representation of pulses of the input pulse train. The waveform 30 is additionally shown in FIG. 4(*a*). The voltage levels of the input pulse train are compatible for use as an input to a digital electronics component.

The output of the processor 26 is connected to an AND gate 32 at a first input 34. The AND gate 32 has a second input 36 connected to the output of a timer 38 through a signal line 40. Additionally, the line 40 connects an inhibit input of a digital to analog converter (D/A) 42 to the output of the timer 38.

An AND gate provides a positive voltage at its output in concurrent response to positive voltages being applied to each of its inputs. As explained hereinafter, pulses of the input pulse train are provided at an output 44 of the AND gate 32 in concurrent response to a positive timing voltage provided by the timer 38 and the output of the processor 26. The AND gate 32 is a type of digital electronics component that is well known to those skilled in the art.

A one shot multivibrator 46 has its output connected to a start input of the timer 38 and a reset input of a counter 48 through a signal line 50. An input of the one shot 46 is connected to ground through a switch 52.

In response to a closure of the switch 52, the one shot 46 provides a negative one shot initiation pulse through the signal line 50. The initiation pulse has a duration that is on the order of one microsecond; the precise duration is of no importance. A waveform 54 is a representation of the initiation pulse. The waveform 54 is additionally shown in FIG. 4(*b*). The one shot 46 is a type of digital electronics component that is well known to those skilled in the art.

In response to the initiation pulse, the counter 48 is reset, thereby causing it to provide a digital signal representation of the number, zero. Additionally, the timer 38 provides a positive timing voltage during a timing interval that is substantially equal to ten milliseconds. A waveform 55 is a representation of the timing voltage. The waveform 55 is additionally shown in FIG. 4(*c*).

Figure 4:
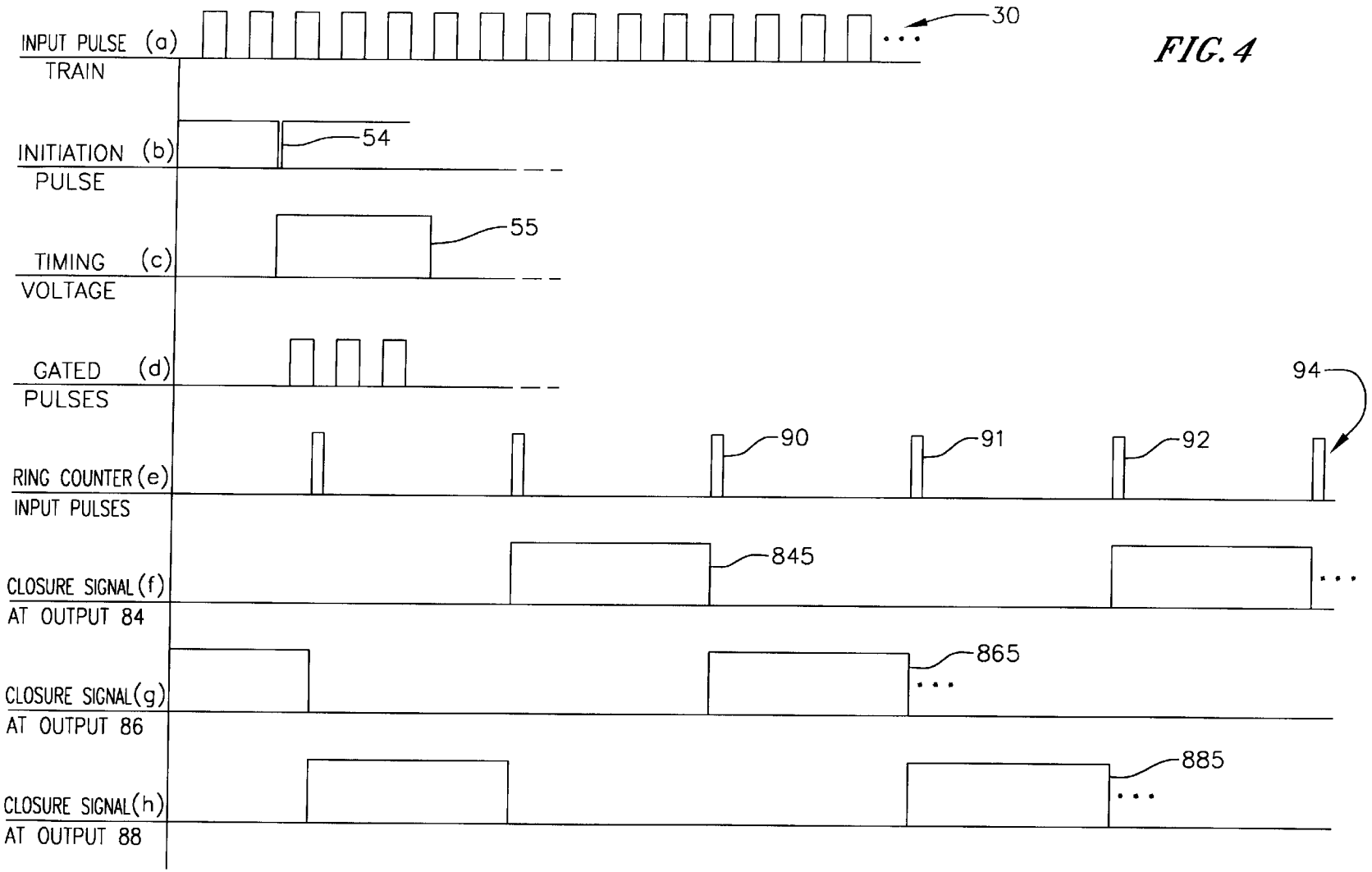
FIG. 4 is a showing of waveforms, all on the same time base, of signals provided in the embodiment of FIG. 2.

During the timing interval, gated pulses of the pulse train are provided at the output 44. FIG. 4(*d*) is a showing of the gated pulses. The timer 38 is a type of digital electronics component that is well known to those skilled in the art.

The output 44 is connected to a count input of the counter 48. The counter 48 stores at its output a digital signal representation of the number of gated pulses. Since the processor circuit 26 provides the pulse train at the pulse repetition rate that equals the radiated output frequency and the output 44 provides the gated pulses during the timing interval, the number of gated pulses is representative of the radiated output frequency (cycles per ten milliseconds).

As explained hereinafter, the output of the counter 48 is used to synthesize a signal that has a frequency which is cyclically varied. More particularly, during first, second and third portions of a synthesis cycle, the synthesized signal is at frequencies that are respectively 10% higher than the radiated output frequency, substantially equal to the radiated output frequency and 90% of the radiated output frequency. The variation of the frequency of the synthesized signal approximates an expected variation of the radiated output frequency caused by one or more large vehicles entering the inductive loop.

The output of the counter 48 is connected to the input of the D/A 42 through a plurality of signal lines 56, whereby the digital signal representation of the number of gated pulses is provided to the D/A 42. During the timing interval, the timing voltage inhibits the D/A 42, thereby causing the D/A 42 to substantially provide zero volts at its output. At the end of the timing interval, the digital signal representation of the number of gated pulses causes the D/A 42 to provide a voltage having an amplitude that is proportional to the radiated output frequency.

The output of the D/A 42 is connected through a synthesis network 57 to a VCO 58 at its input. More particularly, the synthesis network 57 includes similar analog switches 59, 60, 61 with poles 64, 66, 68, respectively, that are all connected to the output of the D/A 42. The switches 59, 60, 61 additionally have respective contacts 70, 72, 74 and respective closure inputs 76, 78, 80. Analog switches are well known to those skilled in the art.

When, for example, a positive signal voltage is applied to the closure input 76, there is a closure of the switch 59 thereby causing a connection of the pole 64 to the contact 70. In a similar manner closure of the switches 60, 61 is provided in response to a positive voltage being applied to the closure inputs 78, 80, respectively.

The inputs 76, 78, 80 are connected to a three stage ring counter 82 at outputs 84, 86, 88, respectively. The ring counter 82 has an input 90 connected to the output of a pulse generator 92 that provides ring counter input pulses at a 100 pulse per second rate. The ring counter input pulses have a duration on the order of ten microseconds; the precise duration is of no importance. A waveform 94 is a representation of the ring counter input pulses. The waveform 94 is additionally shown in FIG. 4(*e*).

The outputs 84, 86, 88 provide first, second and third synthesis signals, respectively. It should be understood that one and only one of the synthesis signals is provided at any given time. Correspondingly, one and only one of the switches 59, 60, 61 is closed at any given time.

The identity of the one of the outputs 84, 86, 88 that provides a synthesis signal changes cyclically. Synthesis signals at the outputs 84, 86, 88 are represented by wavforms in FIG. 4(*f*), FIG. 4(*g*) and FIG. 4(*h*), respectively. Hence, during an exemplary synthesis cycle, waveforms 84S (FIG. 4(*f*)), 86S (FIG. 4(*g*)) and 88S (FIG. 4(*h*)) are representative of the first, second and third synthesis signals, respectively.

Thus, when the output 84 provides the first synthesis signal of the exemplary cycle, a ring counter input pulse 90 (FIG. 4(*e*)) causes the output 86 to provide the second synthesis signal. Thereafter, a ring counter input pulse 91 causes the output 88 to provide the third synthesis signal. A first synthesis signal of a successive synthesis cycle is provided in response to a ring counter input pulse 92. Ring counters are well known to those skilled in the art.

It should be understood that the durations of the first, second and third synthesis signals define first, second and third portions of a synthesis cycle, respectively. Therefore, the switches 59, 60, 61 are respectively closed during the first, second and third portions of a synthesis cycle.

The contact 70 is connected to the input of the VCO 58. The contact 70 is additionally connected to ground through a resistor 96 that has a normalized value of R ohms. The VCO 58 is similar to the VCO 12 of the first embodiment.

The contacts 72, 74 are connected to the input of the VCO 58 through resistors 98, 100, respectively. The resistor 98 has a normalized value of R/9 ohms. The resistor 100 has a normalized value of R/8 ohms.

The closure of the switch 59 causes the output of the D/A 42 to be applied to the input of the VCO 58. In response to the output of the D/A 42, the VCO 58 provides an output signal at a frequency that is approximately 10% higher than the frequency represented by the number of gated pulses.

Because of the value of the resistor 98 (R/9 ohms) and the value of the resistor 96 (R ohms), closure of the switch 60 causes 90% of the output of the D/A 42 to be applied to the input of the VCO 94. In other words, the resistors 96, 98 form a voltage divider. In response to 90% of the output of the D/A 42, the output signal of the VCO 58 has a frequency that approximately equals the frequency represented by the number of gated pulses.

Because of the value of the resistor 100 (R/8 ohms) and the value of the resistor 96 (R ohms), closure of the switch 61 causes 80% of the output of the D/A 42 to be applied to the input of the VCO 94. In other words, the resistors 96, 100 form a voltage divider. In response to 80% of the output of the D/A 42, the output signal of the VCO 58 has a frequency that approximately equals 90% of the frequency represented by the number of gated pulses.

The output of the VCO 58 is connected to a power amplifier 100 whereby the synthesized signal is provided to the power amplifier 100. The power amplifier 100 is similar to the power amplifier 16 that is described in connection with the first embodiment.

The output of the amplifier 100 is connected to an output antenna 102 whereby the antenna 102 transmits a signal at frequencies that are equal to the frequencies of the synthesized signal. The antenna 102 is similar to the antenna 20, that is described in connection with the first embodiment.

It should be understood that because the D/A 42 substantially provides zero volts during the timing interval, the antenna 102 does not transmit during the timing interval. The antenna 102 transmits after the timing interval. Since the pulses of the pulse train are stored during the timing interval and the antenna 102 transmits after the timing interval there cannot be a malfunction due to a regeneration caused by pulses of the pulse train being stored while the antenna 102 is transmitting. Accordingly, the "lock up" of the prior art cannot exist in the apparatus of the second embodiment.

In an alternative embodiment, the synthesis network 57 is not used. The antenna 102 transmits at only a single frequency that is proportional to the radiated frequency.

While the invention has been particularly shown and described with reference to embodiments thereof, it should be understood by those skilled in the art that changes in form and detail may be made therein without departing from the spirit and scope of the invention.

I claim:

1. A vehicle mounted apparatus for prompting a light sequence of a vehicular traffic signal light control system having an inductive loop buried beneath a roadway, said control system controlling the light sequence of the vehicular traffic signal light in response to changes in the inductance of said inductive loop, comprising:

a generator for cyclically generating a signal having a frequency that varies over a known range that includes a frequency of a radiated signal that prompts said light sequence when received by said inductive loop; and a transmitter connected to said generator, for transmitting a signal having said varying frequency.

2. The apparatus of claim 1 wherein said generator comprises:

a signal generator that provides a voltage having a cyclically varying amplitude; and a voltage controlled oscillator that provides an output signal having a frequency that is directly related to the amplitude of a voltage applied to its input, the input of said voltage controlled oscillator being connected to the output of said signal generator.

3. The apparatus of claim 2 wherein said signal generator provides a voltage having a sawtooth waveform.

4. A vehicle mounted apparatus for prompting a light sequence of a vehicular traffic signal light control system having an inductive loop buried beneath a roadway, said control system controlling the light sequence of the vehicular traffic signal light in response to changes in the inductance of said inductive loop, comprising:

a storage device for storing a signal representation of a frequency of radiation from said inductive loop; and a transmitter for transmitting a signal at a frequency that is directly related to said frequency of radiation to thereby prompt the light sequence of said vehicular traffic signal light when received by said inductive loop.

5. The apparatus of claim 4 wherein said storage device comprises:

means for providing pulses of a pulse train at said frequency of radiation; and a counter for storing a signal representation of a number of pulses of said pulse train that are provided during a timing interval.

6. The apparatus of claim 4 wherein said transmitter comprises:

a digital to analog converter that has its input connected to the output of said counter means, said converter providing a voltage proportional to said stored number of pulses;

a voltage controlled oscillator that provides an output signal having a frequency that is directly related to the amplitude of a voltage applied to its input, the input of said voltage controlled oscillator being connected to the output of said converter; and means for inhibiting said transmission during said timing interval.

7. The apparatus of claim 6 additionally comprising a synthesis network for causing a plurality of portions of the output of said analog to digital converter to be cyclically provided to the input of said voltage controlled oscillator.

8. The apparatus of claim 7 wherein the synthesis network comprises:

an analog switch connected to said digital to analog converter;

a voltage divider connected to said analog switch and said voltage controlled; and means for causing a cyclic closure of said analog switch.

9. The apparatus of claim 8 wherein said cyclic closure means is comprises:

a ring counter that has an output connected to a closure input of said analog switch; and a pulse generator connected to said ring counter.

10. A method for a vehicle mounted apparatus for prompting a light sequence of a vehicular traffic signal light control system having an inductive loop buried beneath a roadway, said control system controlling the light sequence of the vehicular traffic signal light in response to changes in the inductance of said inductive loop, comprising:

storing a signal representation of a frequency of radiation from said inductive loop during a timing interval; and transmitting a signal at a frequency that is directly related to said frequency of radiation loop after said timing interval.

11. A vehicle mounted apparatus for prompting a light sequence of a vehicular traffic signal light control system having an inductive loop buried beneath a roadway emitting radiation, said control system controlling the light sequence of the vehicular traffic signal light in response to changes in the inductance of said inductive loop, comprising:

a storage device for storing a signal representation of a frequency of radiation emitted from said inductive loop during a timing interval, comprising:

means for providing pulses of a pulse train at said frequency of radiation; and counter means for storing a signal representation of a number of pulses of said pulse train that are provided during the timing interval; and a transmitter for transmitting a signal at a frequency that is directly related to said frequency of radiation to thereby prompt the light sequence of said vehicular traffic signal light when received by said inductive loop.

12. The apparatus of claim 11 wherein said transmitter comprises:

a digital to analog converter that has its input connected to the output of said counter means, said converter providing a voltage proportional to said stored number of pulses;

a voltage controlled oscillator that provides an output signal having afrequency that is directly related to the amplitude of a voltage applied to its input, the input of said voltage controlled oscillator being connected to the output of said converter; and means for inhibiting said transmission during said timing interval.

13. The apparatus of claim 12 additionally comprising a synthesis network for causing a plurality of portions of the output of said analog to digital converter to be cyclically provided to the input of said voltage controlled oscillator.

14. The apparatus of claim 13 wherein synthesis network comprises:

an analog switch connected to said digital to analog converter;

a voltage divider connected to said analog switch and said voltage controlled; and means for causing a cyclic closure of said analog switch.

15. The apparatus of claim 14 wherein said cyclic closure means is comprises:

a ring counter that has an output connected to a closure input of said analog switch; and a pulse generator connected to said ring counter.

* * * * *